United States Patent [19]

Stehlik

[11] 4,440,064

[45] Apr. 3, 1984

[54] TIMING METHOD FOR MACHINE GUN

[75] Inventor: Miroslva J. Stehlik, Kitchener, Canada

[73] Assignee: Her Majesty the Queen in right of Canada, as represented by the Minister of National Defence, Ottawa, Canada

[21] Appl. No.: 348,664

[22] Filed: Feb. 16, 1982

[30] Foreign Application Priority Data

Mar. 23, 1981 [CA] Canada ..... 373590

[51] Int. Cl.[3] ..... F41D 11/02

[52] U.S. Cl. ..... 89/136

[58] Field of Search ..... 42/69 R, 69 A, 69 B; 89/27 R, 27 F, 132, 136, 141

[56] References Cited

U.S. PATENT DOCUMENTS

| | | | |
|---|---|---|---|
| 851,626 | 4/1907 | Keyse | 42/69 R |
| 2,347,645 | 5/1944 | Sherrer et al. | 42/69 R |
| 2,425,761 | 8/1947 | Staller | 89/27 R |
| 3,863,375 | 2/1975 | Browning | 42/69 R |

FOREIGN PATENT DOCUMENTS

| | | | |
|---|---|---|---|
| 209660 | 4/1940 | Switzerland | 42/69 A |

*Primary Examiner*—Stephen C. Bentley

*Attorney, Agent, or Firm*—Stevens, Davis, Miller & Mosher

[57] ABSTRACT

A timing attachment is described, for use in conjunction with a trigger and firing mechanism of a firearm, to enable adjustment of the timing action of such firearm. The attachment includes a saddle section and a ramp section. The saddle section is configured so as to enable the timing attachment to be seated on the trigger. The ramp section is connected to the saddle section, preferably integrally, and is operable to abut a cross piece in the form of a stationary frame member in the firearm. Securing means are also provided in the timing attachment, preferably in the saddle section, enabling the timing attachment to be adjustably secured to the trigger. This allows the ramp section to variably abut the cross piece and so cause adjustment of the timing action.

5 Claims, 2 Drawing Figures

TIMING METHOD FOR MACHINE GUN

Figure 1:
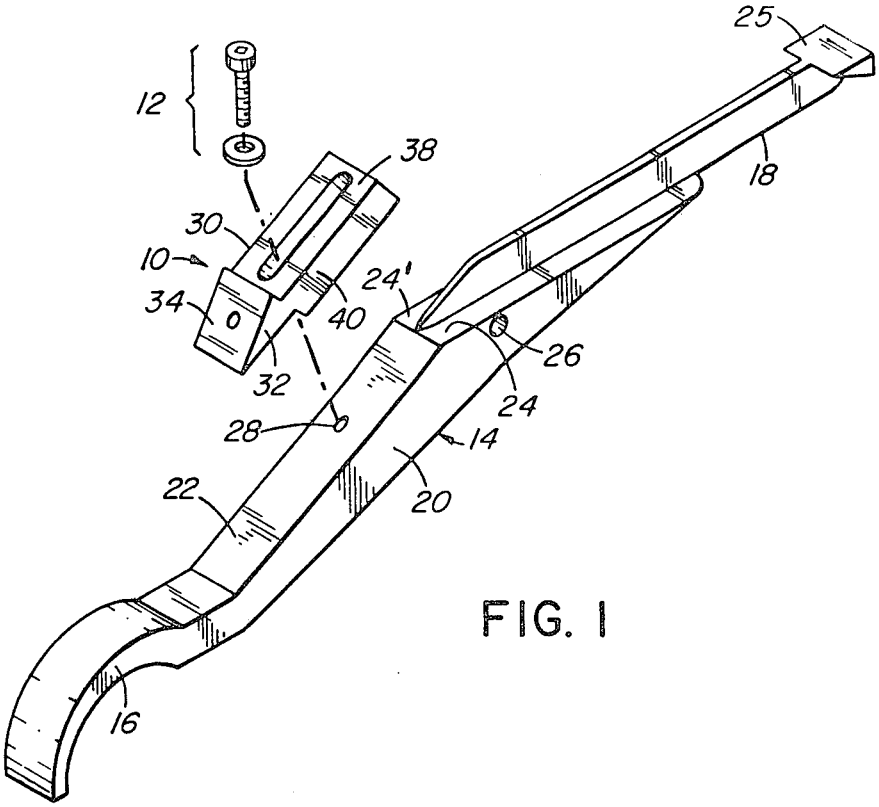

This invention relates to firearms such as machine guns, and more particularly to a timing attachment for use in conjunction with a trigger and firing mechanism as provided in such firearms.

It is known by those knowledgeable in this art that most if not all firearms have trigger and firing mechanisms which have a particular timing action associated with their operation. The reality of this, furthermore, is that such timing action will require some adjustment over the useful life of the firearm. The causes for such adjustment may include such things as wear of parts, dimensional variances due to (mechanical) tolerances in manufacture, replacement of worn or damaged parts with new ones, and so on.

At present, the commonly used "method" of adjusting the timing action is really one of trial and error. In that instance the method involves physically bending the trigger bar, trying it out, and then bending it some more, if required. Such a method is clearly time consuming, leads to excessive consumption of trigger bars due to breakage, and does not permit consistently accurate adjustment of the timing action. Clearly, that "method" is not very satisfactory.

The present invention will overcome many of the shortcomings of the prior art. This invention provides consistent and accurate adjustment of the timing action. Moreover, adjustment can be made quickly and easily.

Accordingly, there is provided by the present invention a timing attachment for use in a trigger and firing mechanism of a firearm to enable adjustment of timing action of said mechanism, comprising a saddle section enabling the timing attachment to be seated on the trigger; and a ramp section connected to the saddle section and operable to abut a cross piece in the form of a stationary frame member in the firearm, the timing attachment also including securing means configured to enable the attachment to be adjustably positioned on the trigger and so vary abutment of the ramp section against the cross piece and adjustment of the timing action.

By another and more preferred embodiment there is provided a timing attachment for use in conjunction with a trigger and firing mechanism of a firearm such as a machine gun, to enable adjustment of timing action of the mechanism, comprising a saddle section shaped to embrace a portion of the trigger, the saddle section including means for adjustably securing the timing attachment to the trigger; and a ramp section connected to the saddle section, the ramp section being operable to abut a cross piece of a lock frame in the firearm, such that adjustably positioning the saddle section on the trigger changes abutment of the ramp against the cross piece so as to cause adjustment of the timing action. The means for securing the timing attachment preferably involves a slot and threaded fastener, one of these being in the attachment and the other in the trigger, thus providing relative movement to allow adjustable positioning of the timing attachment.

It is also preferable that the saddle and ramp sections are integrally connected, i.e., homogeneous.

Various features and advantages of the present invention will become more apparent from the accompanying drawings. These drawings are to be considered in conjunction with the following detailed description.

IN THE DRAWINGS

Figure 2:
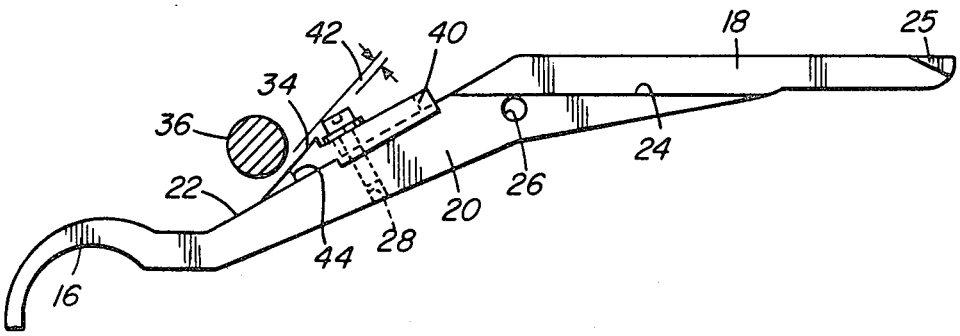

FIG. 1 is an exploded view in perspective of a preferred form of timing attachment envisaged by this invention; and FIG. 2 is a side elevation view of the timing attachment of FIG. 1.

Turning to the drawings, a timing attachment is shown at 10, for attachment by fastening means 12 to a trigger 14. Trigger 14 is part of a trigger and firing mechanism whose structure and operation will be known to persons skilled in this art. The trigger 14 includes a portion 16 curved as shown to accommodate a finger of someone firing the firearm in which the trigger is found. A nose portion 18 is also formed as part of the trigger 14. A central portion of trigger 14 is thickened and somewhat triangularly shaped as seen at 20. The central portion 20 is formed with planar surfaces 22 and 24,24', although surfaces 24,24' are more like shoulders inasmuch as nose portion 18 is integrally formed from central portion 20. The free end of nose portion 18 is formed with a pad-like surface 25 operative to activate other parts of the firing mechanism.

The central portion 20 is provided with a transverse borehole 26, which receives a pin or the like, not shown here, for pivotally mounting the trigger 14 in the lock frame of the firing mechanism. A second borehole is provided in surface 22, extending at right angles to that surface, as shown at 28. This borehole 28 is internally threaded for reasons to become apparent shortly.

In accordance with this invention, the timing attachment 10 comprises a saddle section 30 which preferably is integrally connected to a ramp section 32. Saddle section 30 is generally U-shaped in cross-section. The ramp section 32 has an inclined surface 34 which is intended to contact a spacer or cross piece 36 which in this instance forms a part of the lock frame of the firearm. The surface of ramp section 32 generally opposite to inclined surface 34 is coplanar with the interior surface of a bight portion 38 of the saddle section 30. This is clearly seen from FIG. 2. The saddle section 30 includes flanges 40 which embrace sides of the central portion 20 of the trigger 14 when secured to the latter. As seen from the drawings the bight portion 38 is slotted at 42. The threaded fastening means 12 extend through slot 42, into engagement with treaded forehole 28, and enables some longitudinal movement of timing attachment 10. This in turn enables the surface 34 of the ramp section to adjustably contact spacer 36, thereby angularly repositioning the trigger 14 relative to its pivotal axis in pin 26. Such angular repositioning also causes displacement of the pad surface 25 and hence will cause activation sooner or later of the firing mechanism, depending on the direction in which repositioning occurred.

As compared to prior art techniques, the use of timing attachment 10 enables repeatable, accurate and easy adjustment of the timing gap, represented by space 42 in FIG. 2. Further, such adjustment of the timing gap does not involve any bending or deformation of the nose portion 18 of the trigger, as was required by prior art "techniques".

It is preferable that the timing attachment 10 is an integral unit, made, for example, by machining a preform to the final shape desired. Alternatively, the ramp and saddle sections 32 and 30 could be individually fabricated, for example, by casting; or fabricated and welded or otherwise secured, together. Clearly too, the angle enclosed by the surfaces of ramp section 32 can be varied. A large angle gives a larger amount of variation in the adjustment of the timing gap 42, than would a shallow angle as shown. These are, of course, relative quantities, and experience will soon reveal for a given firearm what is an optimum configuration, i.e., ramp angle shown in FIG. 2 at 44. Also, the surface 34 will usually be planar, however, a curvilinear, cam-like surface could also be used. Calibration markings can be provided on surface 22 to enable adjustment of the timing attachment more quickly.

The fastening means shown at 12 are preferably in the form of a screw and locking washer. However, a bolt and nut arrangement can also be used, as might a fastener or clamp arrangement which grips the flanges 40. Various configurations are thus possible, it being important only that the fastening means enables adjustably repositioning the timing attachment.

A preferred embodiment of this invention has been described, and some variations suggested. It is intended by this invention to encompass all such changes and alternative embodiments as fall within the scope of the claims below.

The embodiments of the invention in which an exclusive property or privilege is claimed are defined as follows:

1. A timing attachment for use in conjunction with a trigger and firing mechanism of an automatic firearm having a stationary cross piece against which said trigger abuts, said attachment, when mounted, being positioned, to enable adjustment of timing action of said mechanism and comprising a saddle section shaped to embrace a portion of the trigger adjacent said cross piece, the saddle section including slot and fastner means for adjustably securing the timing attachment to said trigger; and a ramp section connected to the saddle section, the ramp section being positioned to abut said cross piece such that adjustably positioning the saddle section on the trigger changes abutment of the ramp against the cross piece so as to cause adjustment of said timing action.

2. The timing attachment defined in claim 1, wherein the fastening means on the saddle section are in the form of a threaded fastener.

3. The timing attachment defined in claim 1, wherein said ramp section has a flat planar surface thereon which abuts said cross piece.

4. The timing attachment defined in claim 1, wherein the saddle and ramp sections are homogeneous.

5. The timing attachment defined in claim 1 wherein the saddle and ramp sections are machined from one piece.

* * * * *